US006288687B1

(12) United States Patent
Glatz

(10) Patent No.: US 6,288,687 B1
(45) Date of Patent: Sep. 11, 2001

(54) ANTENNA CONTACT

(75) Inventor: Andreas Glatz, Lund (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/483,357

(22) Filed: Jan. 14, 2000

(30) Foreign Application Priority Data

Jan. 21, 1999 (SE) ..... 9900199

(51) Int. Cl.[7] ..... H01Q 1/50
(52) U.S. Cl. ..... 343/906; 343/702
(58) Field of Search ..... 343/906, 702, 343/715

(56) References Cited

U.S. PATENT DOCUMENTS

| | | | | |
|---|---|---|---|---|
| 3,946,390 | * | 3/1976 | Alexander et al. | 343/702 |
| 4,862,182 | | 8/1989 | Egashira | 343/702 |
| 5,412,393 | * | 5/1995 | Wiggenhorn | 343/702 |
| 5,557,287 | * | 9/1996 | Pottala et al. | 343/702 |
| 5,861,851 | | 1/1999 | Chang | 343/702 |
| 5,936,582 | * | 8/1999 | Wallace et al. | 343/702 |
| 6,075,487 | * | 6/2000 | Ito | 343/702 |

FOREIGN PATENT DOCUMENTS

| | | |
|---|---|---|
| 0 697 771 A1 | 2/1996 | (EP) . |
| 0 766 339 A2 | 4/1997 | (EP) . |
| WO 98/13903 | 4/1998 | (WO) . |

OTHER PUBLICATIONS

I. Falk, International–Type Search Report, Search Request No. SE99/00067, Nov. 9, 1999, pp. 1–4.

* cited by examiner

*Primary Examiner*—Don Wong
*Assistant Examiner*—Ephrem Alemu
(74) *Attorney, Agent, or Firm*—Jenkens & Gilchrist, A Professional Corporation

(57) ABSTRACT

An antenna contact in a mobile terminal is disclosed. A connecting part is electrically connected to a ground plate when the connecting part is electrically disconnected from a circuit board arranged inside the mobile terminal. The connecting part is then electrically disconnected from the ground plate when the connecting part is electrically connected to the circuit board.

4 Claims, 1 Drawing Sheet

ANTENNA CONTACT

FIELD OF INVENTION

The present invention relates to an antenna contact in a mobile terminal, referably in a mobile telephone.

BACKGROUND OF THE INVENTION

FIG. 1 discloses the antenna contact 20 in the back casing of the mobile phone 10. The antenna contact is used to connect the mobile phone 10 with the external antenna of a vehicle (e.g. a car) in order to be able to receive and transmit radio signals with high signal quality. When the mobile phone 10 via the antenna contact 20 is plugged onto the external antenna connector arranged in the car panel, the antenna of the mobile phone is disconnected and the external car antenna (normally situated on the car roof) is connected to the mobile phone.

However, when the antenna contact is not in use, which is the normal case (hand held mode), the antenna contact is an open road for ESD (Electro Static Discharge) pulses, which propagate from the outside of the phone through the antenna contact to the electrical components (front end components) inside the phone, wherein these ESD-pulses adversely affect these components. Components that are very sensitive to ESD-pulses are e.g. the antenna switch, SAW-filter, and PIN-diodes. It should be realised that even though the antenna contact does not have any galvanic contact with the phone antenna (circuit board) the ESD-pulse will propagate this way. Laboratory tests have shown that a very common reason for the mobile phone to break is that ESD-pulses from the antenna contact have destroyed some RF (Radio Frequency) components.

Electro static fields generating the above ESD-pulses could for example emanate from the user of the phone. When the fingers of the user hand are rubbing the phone casing the fingers are electrically charged implying a discrepancy in voltage potential between the fingers and the phone casing, which could result in an electrostatic discharge.

Another dangerous situation, which could create ESD-pulses, is when the mobile phone is to be plugged onto the external antenna connector in the car panel. When the phone approaches the external antenna connector in the car panel, there may be an electrostatic discharge from the external antenna connector to the mobile phone due to a potential discrepancy between the mobile phone and the external antenna connector. This discharge could damage the components in the mobile phone.

The above discussed ESD problems are usually solved with some kind of electrical components, which take care of high voltages either by absorbing the pulses arising from the voltages or leading them to ground. Up to now these problems have been solved by different arrangement of PIN-diodes, zener-diodes, shottky-diodes, and varistors.

However, these arrangements have several drawbacks. For example, they tend to distort signals passing through them. The arrangement of diodes causes losses of inserted signals.

Another drawback with the arrangement is that a certain voltage level must be defined. Above this level the arrangement should discharge the voltage and below this level the voltage should be left unaffected. The problem is to define this voltage level. Since there is a voltage level the ESD protection will not work for voltage pulses below said level.

Yet another problem is that for high power ESD pulses, the ESD protection components will break.

Thus, an object of the present invention is to solve the above discussed problems and overcome said drawbacks.

SUMMARY OF THE INVENTION

The above object is achieved by means of an antenna contact. The antenna contact includes a connecting part, which is electrically connected to ground when it is not connected to the printed circuit board in the mobile phone. Thus, the connecting part is connected to ground when the antenna contact is not in use, which implies that all ESD-pulses arisen inevitable will be led to ground.

Since the connecting part is connected to ground when the antenna contact is not used, i.e. not plugged onto the external antenna connector in the car panel, all ESD pulses (both small and large ones) will be led to ground. In addition to this the ESD-pulses will not at all affect the radio signal since no signal from the antenna contact will pass the gap between the connecting part and the circuit board when the connecting part is connected to ground.

In a preferable embodiment of the invention, a contact electrode is arranged inside an insulating muff and connected to a ground plate when the antenna contact is not in use.

Another advantageous embodiment is disclosed in which the insulating muff presses the ground plate away from the contact electrode when the connecting part is moved towards the circuit board.

Another advantageous embodiment discloses a preferable wedge-shaped insulating muff. The wedge shaped muff facilitates the contact between the contact electrode and the ground plate as well as the disconnection of the contact electrode from the ground plate.

Other characteristics of the invention are set out in other dependent claims.

BRIEF DESCRIPTION OF THE DRAWINGS

The present invention will now be described in more detail with reference preferred embodiments of the present invention, given only by way of examples, and illustrated in the accompanying drawings in which.

DETAILED DESCRIPTION OF EMBODIMENTS OF THE INVENTION

Figure 1:
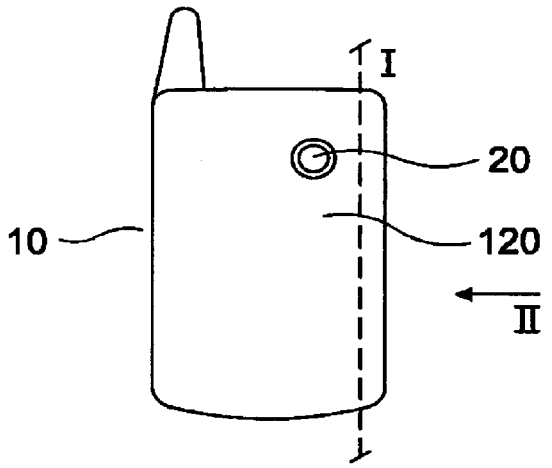
FIG. 1 illustrates the back casing of a mobile telephone and its antenna contact.

FIG. 1 discloses the backside of a mobile phone 10. As can be seen an antenna contact 20 is arranged in the upper part of the back casing. The use of the antenna contact has been discussed under headline "Background of the invention" and will not be further discussed.

Figure 2:
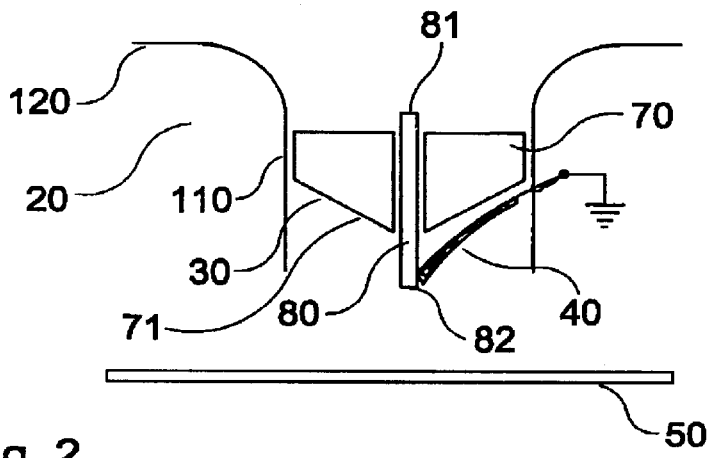
FIGS. 2 and 3 illustrate sectional views of the antenna contact taken along line I according to the invention.
Figure 3:
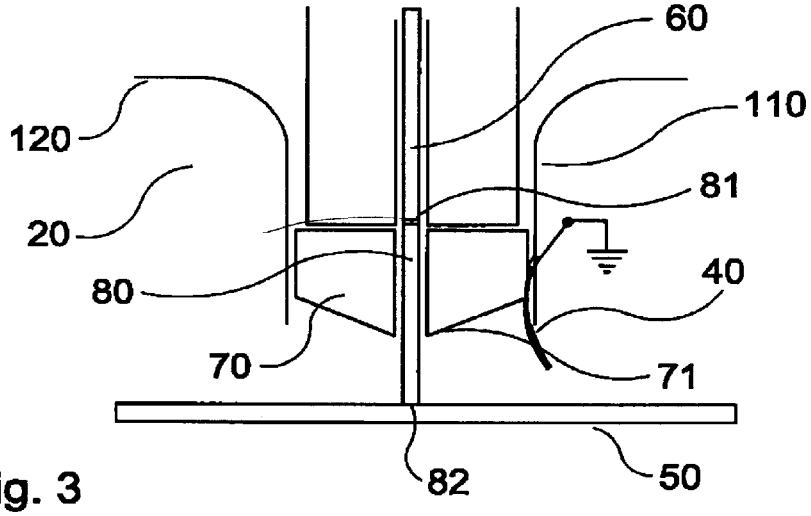

FIGS. 2 and 3, respectively disclose a sectional view of the antenna contact 20 taken along the line I seen in the direction of the arrow II in FIG. 1. The antenna contact 20 of FIG. 1 contains a connecting part 30, which can be vertically moved inside a tube/pipe formed device110 in order to either contact a ground plate 40 or a Printed Circuit Board (PCB) 50 inside the phone 10. The connecting part 30 comprises a contact electrode 80 arranged inside a preferable circular insulating muff 70. The muff is disclosed in a sectional view in both figures and it could be seen that the contact electrode is arranged in the middle of the muff. The end 71 of the muff facing the ground plate 40 is wedge-shaped, which implies that it allows a natural contact between the contact electrode 80 and the ground plate 40 when the antenna contact is not in use (FIG. 1). When, on the contrary, the contact electrode 80 is pressed into contact with the PCB 50, the wedge-shaped surface of the muff presses away the ground plate 40 from the contact electrode in order to break the contact between them, which can be seen in FIG. 2.

In FIG. 1 the antenna contact 20 is not in use, which means that the phone is not plugged onto the external connector 60 of the car panel (not shown). When the antenna contact is not in use, the contact electrode 80 is in contact with a ground plate 40, which implies that all ESD-pulses arisen outside the phone are led to ground. As can be seen in FIG. 2 the mobile phone 10 is plugged onto the external antenna connector 60 arranged in the car panel as described above. The external antenna 60 connector presses the connecting part 30 through the tube-shaped device 110 into electrical contact with the PCB and at the same time the muff presses away the ground plate from the contact electrode as mentioned above. It should be realised that the upper part of the tube formed device 110 of the antenna contact 20 facing the phone casing 10,120 has a conical shape with its largest area facing the phone casing 120.This conical shape facilitates the introduction of the external antenna connector 60 in the antenna contact 20. It should be emphasised that with ground plate, a plate connected to signal ground is meant (voltage close or equal to zero). The ground plate is made of some conductive material, preferable metal. It should be realised that the ground plate could be arranged in another way in order to keep the connecting part to ground when the antenna contact is not used. For example the ground plate could be arranged in a perpendicular position in relation to the contact electrode; the ground plate could be pressed into contact with the contact electrode by means of a spring arrangement.

It would be appreciated by those of ordinary skill in the art that the present invention could be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalence thereof are intended to be embraced therein.

What is claimed is:

1. An antenna contact in a mobile terminal, comprising:

a connecting part including a contact electrode arranged in an insulating tube; and ground means, said connecting part being electrically connected to said ground means when said connecting part is electrically disconnected from a circuit board arranged inside said mobile terminal, and said connecting part being electrically disconnected from said ground means when said connecting part is in electrical contact with said circuit board;

wherein said insulating tube is arranged to press said ground means away from said contact electrode to disconnect them from each other, when said contact electrode is in electrical contact with said circuit board.

2. An antenna contact as claimed in claim 1, wherein said contact electrode at its second end is in electrical contact with said circuit board when an external antenna connector electrically contacts a first end of said contact electrode.

3. An antenna contact as claimed in claim 1, wherein said insulating tube has a wedge-shaped surface facing said ground means.

4. An antenna contact as claimed in claim 3, wherein said ground means is a metal plate connected to signal ground.

* * * * *